US012398606B2

(12) United States Patent
Shaikh et al.

(10) Patent No.: US 12,398,606 B2
(45) Date of Patent: Aug. 26, 2025

(54) MECHANICAL STOP ARRANGEMENT FOR A BOREHOLE TUBULAR TO LOCATE AND RESTRAIN A BOREHOLE TOOL TO AN OUTSIDE DIAMETER OF THE TUBULAR, METHOD, AND SYSTEM

(71) Applicant: Baker Hughes Oilfield Operations LLC, Houston, TX (US)

(72) Inventors: Farhat A. Shaikh, Houston, TX (US); Jeffrey Honekamp, Tomball, TX (US); Jamie Imhoff, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/471,989

(22) Filed: Sep. 21, 2023

(65) Prior Publication Data

US 2025/0101824 A1 Mar. 27, 2025

(51) Int. Cl.
*E21B 23/01* (2006.01)
*E21B 7/04* (2006.01)
(Continued)

(52) U.S. Cl.
CPC ..... *E21B 23/01* (2013.01); *E21B 7/04* (2013.01); *E21B 33/1212* (2013.01);
(Continued)

(58) Field of Classification Search
CPC ..... E21B 23/0411; E21B 23/01; E21B 23/03; E21B 33/1212; E21B 33/1291
See application file for complete search history.

(56) References Cited

U.S. PATENT DOCUMENTS 2,582,700 A * 1/1952 Jones ..... E21B 43/101 277/336
3,631,924 A * 1/1972 McGill ..... E21B 33/1293 166/134
(Continued)

OTHER PUBLICATIONS

Notification of Transmittal of the International Search Report and the Written Opinion of the International Searching Authority, or the Declaration; PCT/US2024/046886; mail date: Dec. 26, 2024; 11 pages.

*Primary Examiner* — Taras P Bemko
(74) *Attorney, Agent, or Firm* — Baker Hughes Patent Organization

(57) ABSTRACT

A mechanical stop arrangement includes a first coupler having a tool connection segment, and an arrangement connection segment, a second coupler having a first connection segment connectable with the arrangement connection section, and a frustoconical inside diameter surface, and a wedge having a radially outside surface angle that is complementary to the frustoconical inside diameter surface. A method for connecting a borehole tool to an outside surface of a tubular, including connecting the borehole tool to a first coupler either before or after disposing the coupler on the tubular, disposing the first coupler on the tubular, disposing a wedge on the tubular, disposing a second coupler on the tubular, interconnecting the first coupler and the second coupler, and jamming the wedge against the tubular with the interconnecting. A wellbore system, including a borehole, a string in the borehole, and an arrangement, disposed within or as a part of the string.

22 Claims, 8 Drawing Sheets

(51) Int. Cl.

| | |
|---|---|
| ***E21B 33/12*** | (2006.01) |
| ***E21B 33/129*** | (2006.01) |
| ***E21B 43/10*** | (2006.01) |
| ***E21B 43/12*** | (2006.01) |

(52) U.S. Cl.
CPC ..... *E21B 33/1291* (2013.01); *E21B 43/106* (2013.01); *E21B 43/12* (2013.01)

(56) References Cited

U.S. PATENT DOCUMENTS

| | | | | |
|---|---|---|---|---|
| 5,226,494 | A * | 7/1993 | Rubbo | E21B 34/066 166/66.4 |
| 5,931,232 | A | 8/1999 | Echols et al. | |
| 6,378,915 | B1 | 4/2002 | Katz | |
| 8,281,854 | B2 | 10/2012 | Gaudette et al. | |
| 2005/0224227 | A1* | 10/2005 | Hendrie | E21B 17/1014 166/241.6 |
| 2009/0139709 | A1 | 6/2009 | Doane | |
| 2011/0042104 | A1 | 2/2011 | Xu | |
| 2020/0018131 | A1* | 1/2020 | Telfer | E21B 33/129 |
| 2024/0003216 | A1* | 1/2024 | Duggan | E21B 33/128 |

* cited by examiner

MECHANICAL STOP ARRANGEMENT FOR A BOREHOLE TUBULAR TO LOCATE AND RESTRAIN A BOREHOLE TOOL TO AN OUTSIDE DIAMETER OF THE TUBULAR, METHOD, AND SYSTEM

BACKGROUND

In the resource recovery and fluid sequestration industries, tools that are secured to an outside diameter of a tubular are often welded thereto. Alternatively, bracketry is known that uses set screws or clamping arrangements where two halves of a bracket are bolted together. Welding requires highly skilled labor and the brackets that are clamped onto tubulars are large and cumbersome. The only answer for operators has been to incur the expense and delay associated with sending components to a shop specifically set up to weld. The art would well receive alternatives that reduce cost and make local modifications for specific well operations easy to do on site.

SUMMARY

An embodiment of a mechanical stop arrangement for a borehole tubular to locate and restrain a borehole tool to an outside diameter of the tubular, including a first coupler dimensioned and configured to be disposed about the borehole tubular and having a tool connection segment configured to connect with a downhole tool, and an arrangement connection segment, a second coupler dimensioned and configured to be disposed about the borehole tubular and having a first connection segment connectable with the arrangement connection section, and a frustoconical inside diameter surface, and a wedge having a radially outside surface angle that is complementary to the frustoconical inside diameter surface.

An embodiment of a method for connecting a borehole tool to an outside surface of a tubular, including connecting the borehole tool to a first coupler either before or after disposing the coupler on the tubular, disposing the first coupler on the tubular, disposing a wedge on the tubular, disposing a second coupler on the tubular, interconnecting the first coupler and the second coupler, and jamming the wedge against the tubular with the interconnecting.

An embodiment of a wellbore system, including a borehole in a subsurface formation, a string in the borehole, and an arrangement, disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
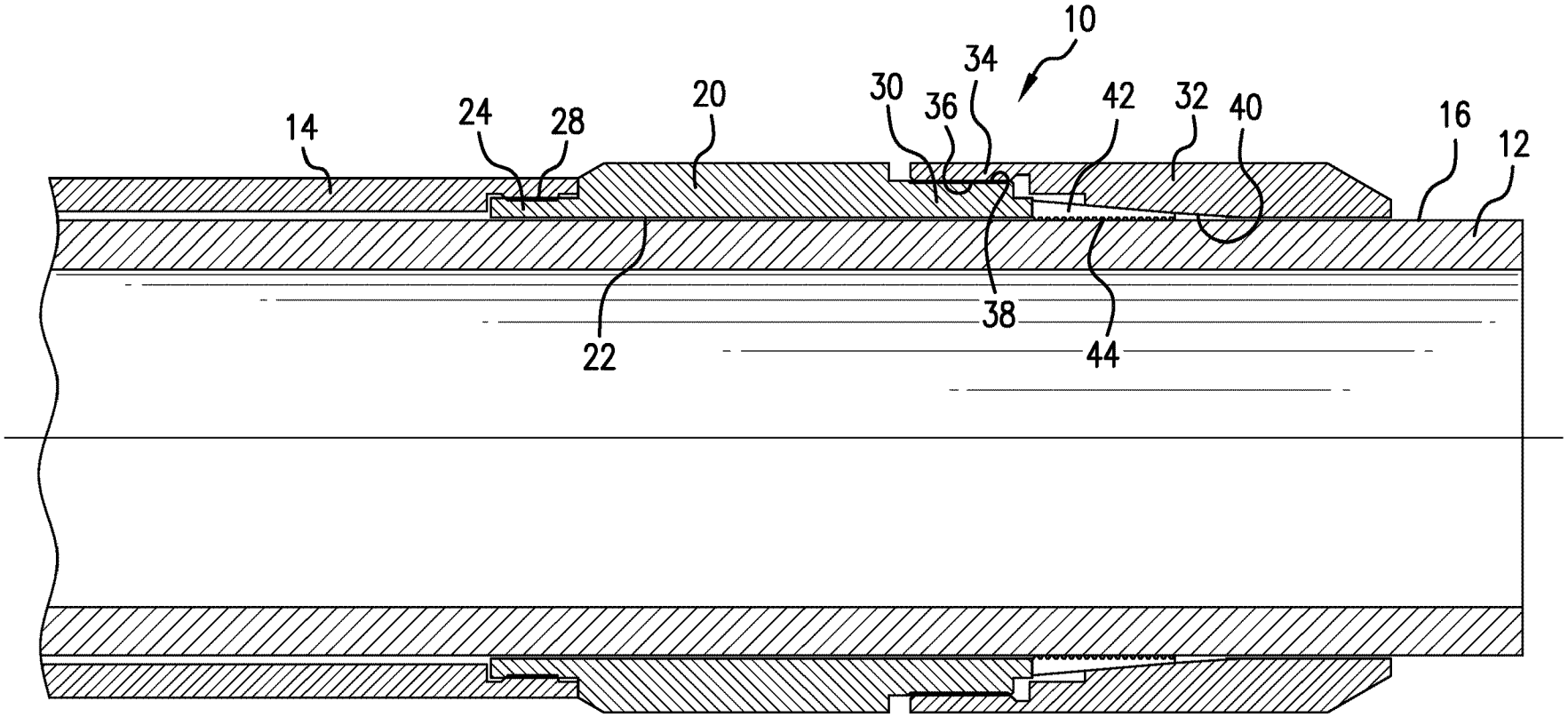
FIG. 1 is a schematic view of a mechanical stop arrangement for a borehole tubular to locate and restrain a borehole tool to an outside diameter of the tubular.

Referring to FIG. 1, a mechanical stop arrangement 10 for a borehole tubular 12 to locate and restrain a borehole tool 14 to only an outside diameter surface 16 of a separate borehole tubular 12 that extends past each of two opposing first and second longitudinal ends of the arrangement 10. The arrangement 10 facilitates attachment of borehole tools to an outside surface of tubular members such as drill pipe, coiled tubing, etc. without modification of the underlying tubular. The arrangement 10 is usable in any location on the tubular 12 and can be assembled in the field using relatively unskilled labor. The arrangement 10 allows for in the field and on the fly modification of borehole tools being selected and combined for use all while avoiding the need for welding or other laborious and skilled worker intensive treatments. The arrangement 10 includes a first coupler 20 that is configured with an inside diameter 22 that is a clearance fit for a target type of tubular 12. The clearance fit is of tight tolerance of not more than 0.125 inch. First coupler 20 includes a tool connection segment 24 configured to connect with the downhole tool 14. The connection may be a threaded connection 28 or may employ radially directed fastening features (such as screws, pins, etc.). the tool 14 is illustrated schematically and is intended to represent inflow control devices such as screens, valves, etc., or a liner hanger, a packer, electronics (such as sensors, gauges, batteries, processors, memory, etc.). It will be noted that the first coupler 20 at least, may have a radial dimension that is larger than a radial dimension of the tool 14 and hence may provide impact protection for the tool 14. At an opposite end of first coupler 20, is an arrangement connection segment 30.

A second coupler 32 is attachable to the first coupler 20 at a first connection segment 34. In an embodiment, the first connection segment 34 exhibits a thread 36 that is engagable with a complementary thread 38 on the arrangement connection segment. Second coupler 32 defines a frustoconical inside surface 40 having an angle measured from a longitudinal axis of the arrangement 10 of about 3 to about 15 degrees. In one embodiment, the angle is about 3 to about 5 degrees.

Disposed radially inwardly of the second coupler 32, when assembled, is a wedge 42. Wedge 42 may be fully annular, part annular, a split ring, or a series of one or more slip-type members arranged annularly. When in use, the wedge 42 is trapped between the frustoconical surface 40 and the tubular surface 16 to create a load bearing interface that will not slide. In some embodiments, the wedge may be smooth while in others, the wedge 42 may be configured with a texture at least on a tubular interface surface 44. Textures include serrations, teeth, wickers, knurls, thread, roughness, etc. and any of the surfaces of the wedge 42 may be hard-faced by such processes as heat treating, carburizing, Nitriding, etc.

It is further noted that the wedge 42 may be configured to create a seal with the surface 40 and the surface 16 using a metal-to-metal seal, a coating seal (elastomeric, polymeric, soft metal, etc.). Sealing as such may be obtained regardless of the type of wedge disclosed above but some types of sealing are better associated with some types of wedge such as an annular ring wedge is best for a metal to metal seal.

Figure 2:
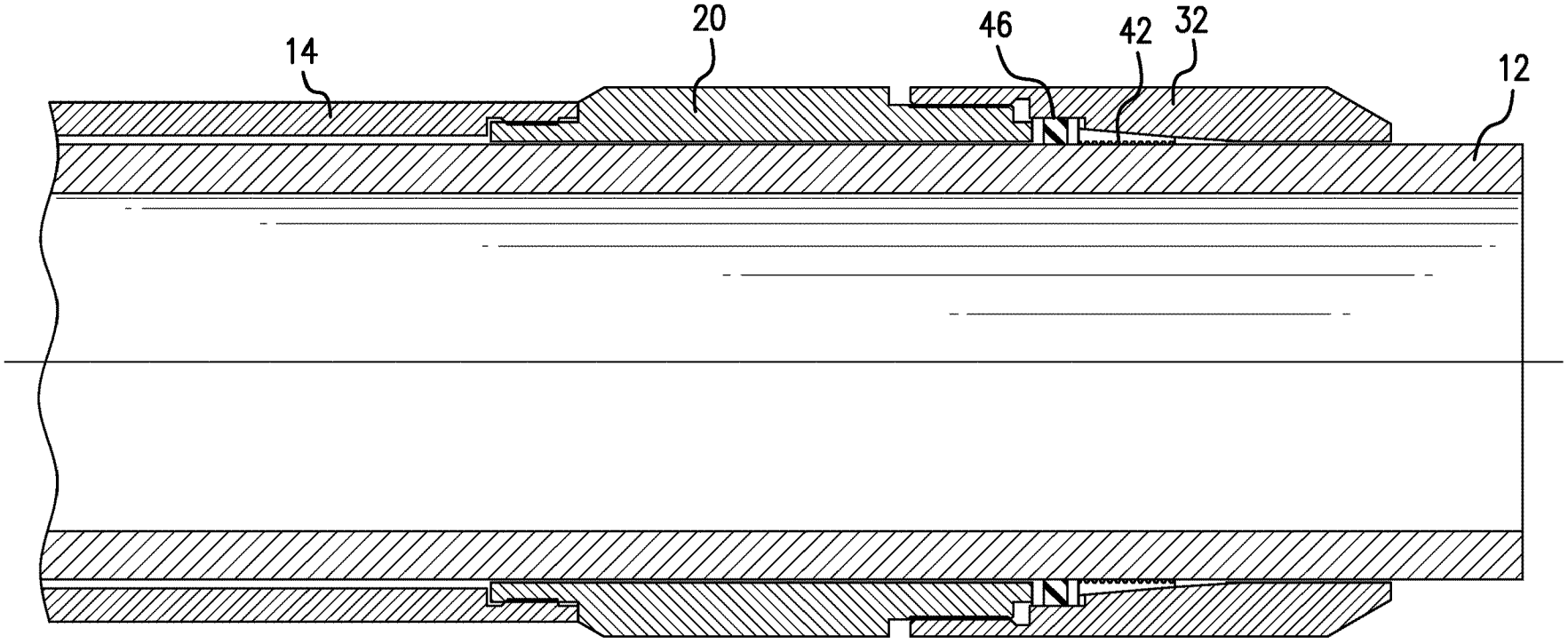
FIG. 2 is a schematic view of a mechanical stop and seal arrangement for a borehole tubular to locate and restrain a borehole tool to an outside diameter of the tubular.

In another embodiment of the arrangement 10, referring to FIG. 2, a dedicated seal 46 is added. The components are labeled with the same numerals as they are substantially identical but for additional length left for the seal 46. Seal 46 may be a packing element, an O-ring, a bonded seal, or other sealing configuration. Seal 46 is energized into sealing contact with the surface 16 of the tubular 12, the second coupler 32 and the first coupler 20 during threading of the first and second couplers together. Accordingly, while the wedge 42 is being driven into the surface 16, the seal is also making sealing contact therewith. This arrangement allows use with tools 14 that require pressure differentials to be applied to actuate the tools.

Figure 3:
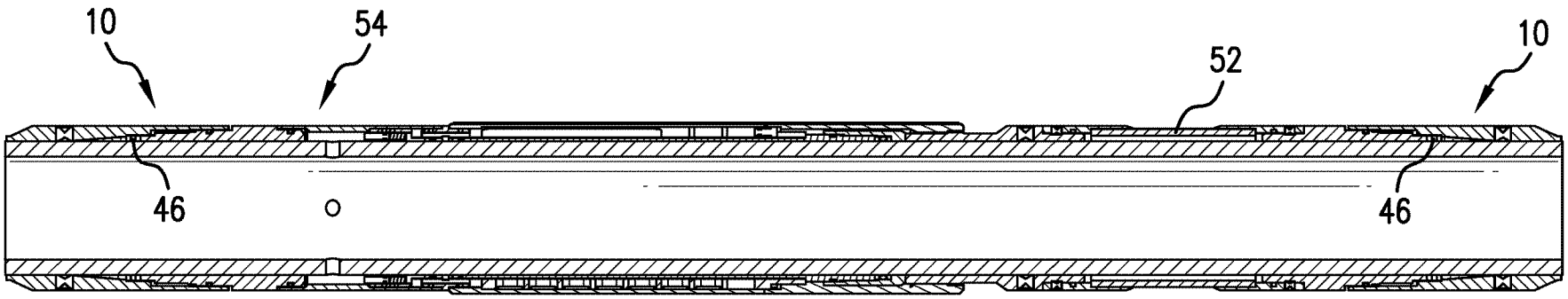
FIG. 3 is a section view of a system employing the stop of FIG. 1.

Referring to FIG. 3, one system is illustrated with an arrangement 10 on either end and supporting a tool 14. In this case the tool 14 includes a screen 52 and a pressure actuated valve 54 such as an MTV™ pressure actuated valve available from Baker Hughes, Houston, Texas. Due to the seals 46 in this system, pressure can be managed to actuate the tool 14 properly.

Figure 4:
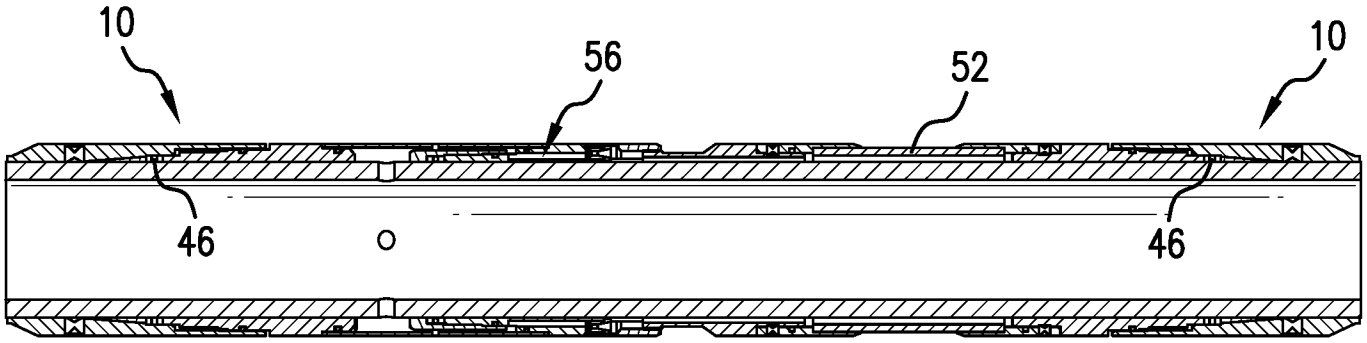
FIG. 4 is a section view of another system employing the stop of FIG. 1.

Referring to FIG. 4, another exemplary system is illustrated. This is similar to FIG. 3 but includes a nozzle 56.

Figure 5:
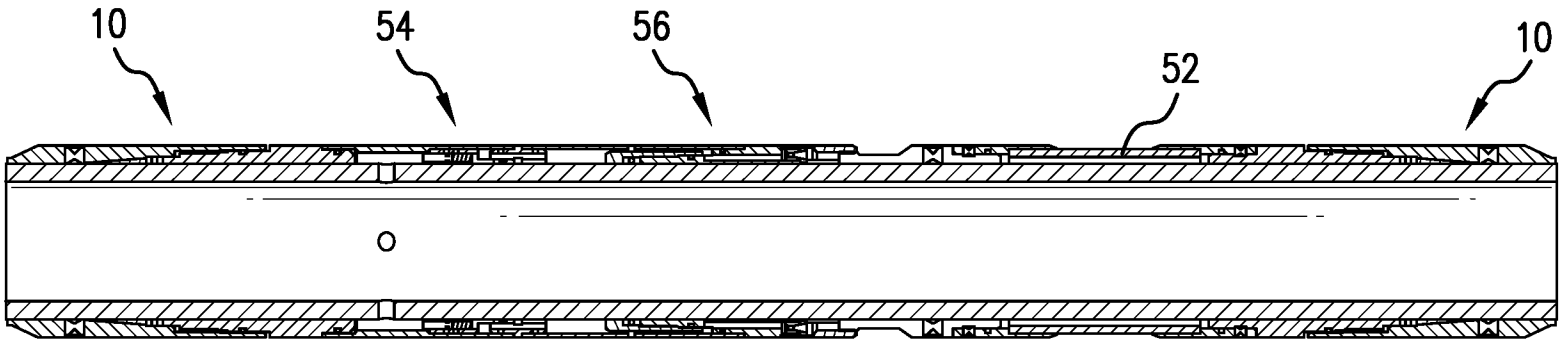
FIG. 5 is a section view of another system employing the stop of FIG. 1.

Referring to FIG. 5, yet another exemplary system is illustrated that includes both the pressure actuated valve and the nozzle. The various configurations of FIGS. 3-5 illustrate the effective modularity and modifiability of the ultimate system in the field at point of use. Due to the arrangement 10, the various tools 14 may be disposed upon the tubular 12 and secured thereon using one or more of the arrangements 10. These systems may also be reconfigured and or repaired as well due to the fact that the arrangement 10 may be unscrewed to remove the tools 14.

Figure 6:
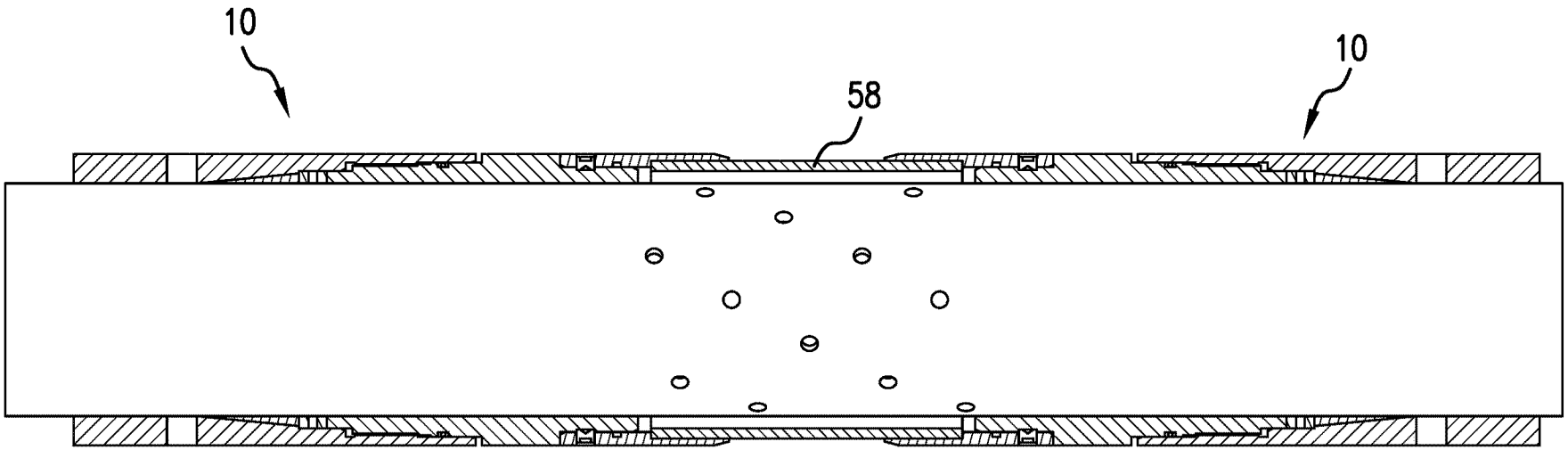
FIG. 6 is a section view of another system employing the stop of FIG. 1.

FIG. 6 illustrates another exemplary system that employs a sand screen 58 as the tool 14.

Figure 7:
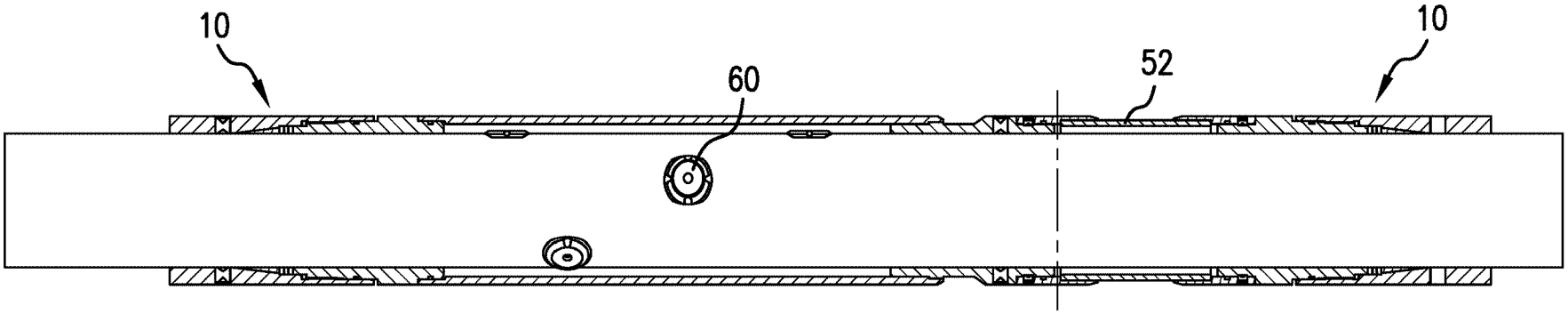
FIG. 7 is a section view of another system employing the stop of FIG. 1.

FIG. 7 illustrates another exemplary system that employs a sand screen 52 and a Bernoulli type valve 60 as the tool 14.

Figure 8:
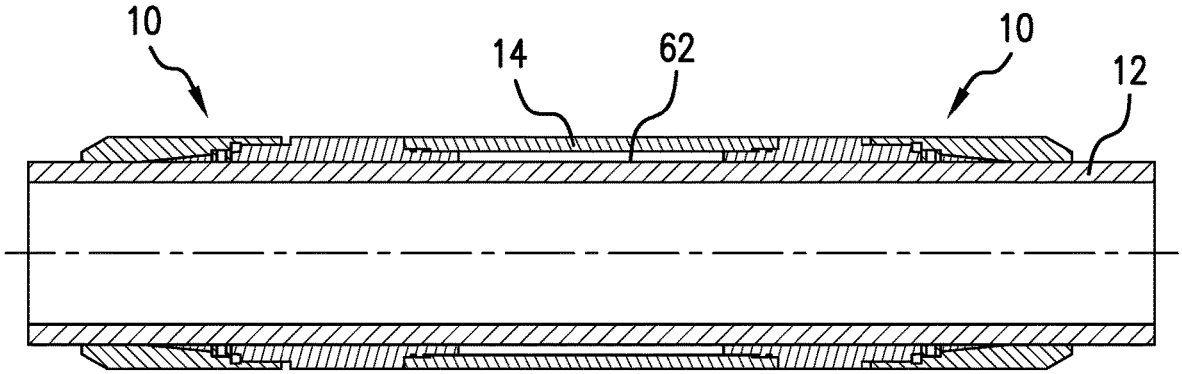
FIG. 8 is a section view of another system employing the stop of FIG. 1.

FIG. 8 illustrates another exemplary system where a chamber 62 is created to house, for example electronic components in a protected environment. In this case the tool 14 is a sleeve that bridges between two arrangements 10 and creates the chamber 62 annularly between the tool 14 and the tubular 12. The protection afforded may be merely from impact without sealing or may be also from wellbore fluids using the sealing described hereinabove. Sensitive componentry may be protected anywhere along the tubular using the mechanical stop arrangements 10 as described herein.

Figure 9:
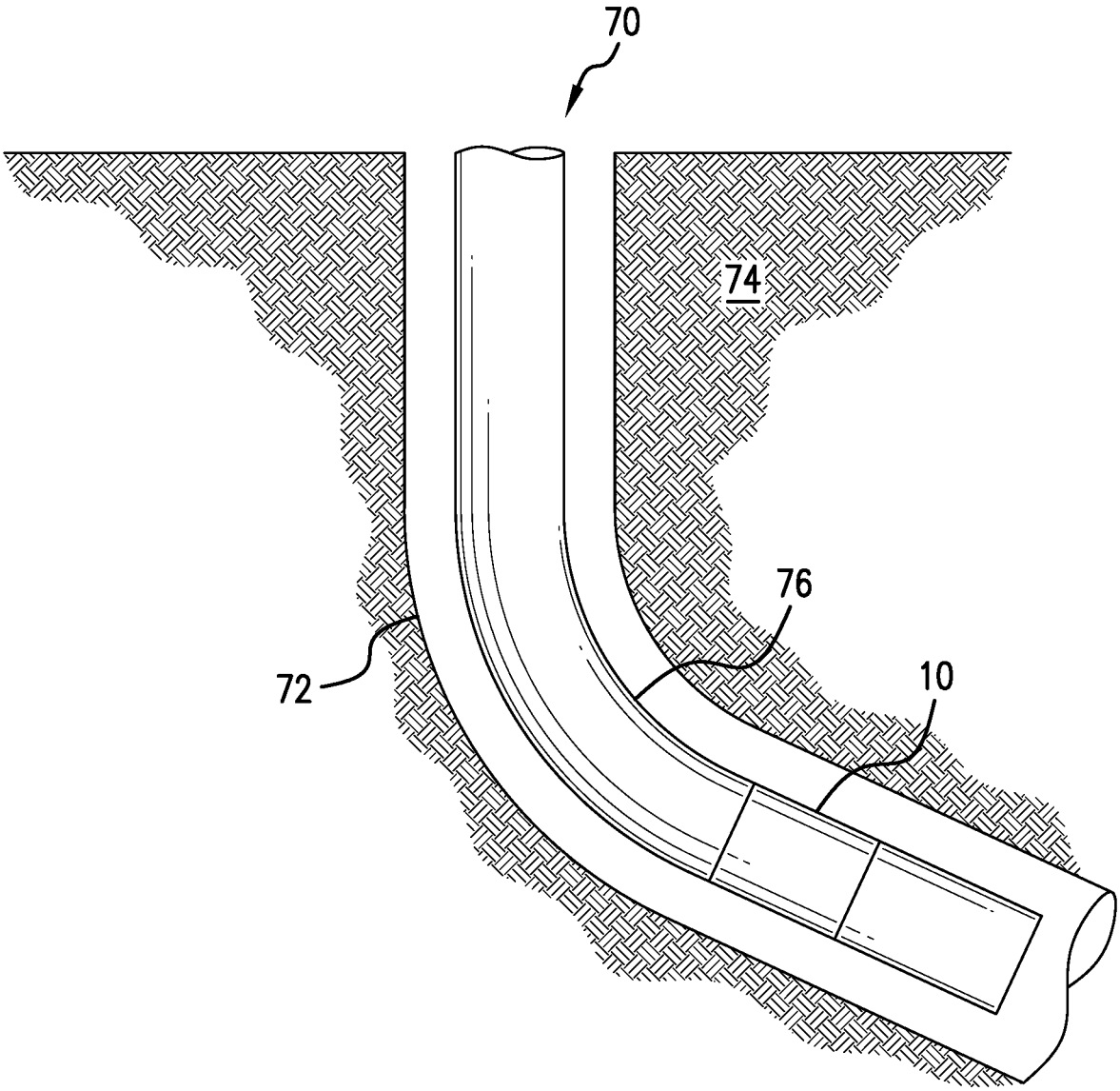
FIG. 9 is a view of a borehole system including is the mechanical stop arrangement as disclosed herein.

Referring to FIG. 9, a borehole system 70 is illustrated. The system 70 comprises a borehole 72 in a subsurface formation 74. A string 76 is disposed within the borehole 72. An arrangement 10 as disclosed herein is disposed within or as a part of the string 76.

Set forth below are some embodiments of the foregoing disclosure:

Embodiment 1: A mechanical stop arrangement for a borehole tubular to locate and restrain a borehole tool to an outside diameter of the tubular, including a first coupler dimensioned and configured to be disposed about the borehole tubular and having a tool connection segment configured to connect with a downhole tool, and an arrangement connection segment, a second coupler dimensioned and configured to be disposed about the borehole tubular and having a first connection segment connectable with the arrangement connection section, and a frustoconical inside diameter surface, and a wedge having a radially outside surface angle that is complementary to the frustoconical inside diameter surface.

Embodiment 2: The arrangement as in any prior embodiment, further comprising a seal disposable between the first coupler and second coupler and configured and dimensioned to create a seal against the tubular, when the arrangement is in use.

Embodiment 3: The arrangement as in any prior embodiment, wherein the seal is in contact with the wedge, the second coupler and the first coupler and subject to compression by the arrangement.

Embodiment 4: The arrangement as in any prior embodiment, wherein the wedge also creates a seal.

Embodiment 5: The arrangement as in any prior embodiment, wherein the seal is metal to metal.

Embodiment 6: The arrangement as in any prior embodiment, wherein the wedge includes a sealing material coating.

Embodiment 7: The arrangement as in any prior embodiment, wherein the wedge is a ring.

Embodiment 8: The arrangement as in any prior embodiment, wherein the wedge is a split ring.

Embodiment 9: The arrangement as in any prior embodiment, wherein the wedge is a plurality of wedges arranged about the tubular when in use.

Embodiment 10: The arrangement as in any prior embodiment, wherein the wedge includes a surface texture.

Embodiment 11: The arrangement as in any prior embodiment, wherein the surface texture is teeth.

Embodiment 12: The arrangement as in any prior embodiment, wherein the surface angle is in a range of about 3 degrees to about 15 degrees from a longitudinal axis of the arrangement.

Embodiment 13: The arrangement as in any prior embodiment, wherein the surface angle is in a range of about 3 degrees to about 5 degrees from a longitudinal axis of the arrangement.

Embodiment 14: The arrangement as in any prior embodiment, wherein the borehole tool is an inflow control tool.

Embodiment 15: The arrangement as in any prior embodiment, wherein the borehole tool is a liner hanger.

Embodiment 16: The arrangement as in any prior embodiment, wherein the borehole tool is a packer.

Embodiment 17: The arrangement as in any prior embodiment, wherein the borehole tool is electronics.

Embodiment 18: The arrangement as in any prior embodiment, wherein the borehole tool creates a chamber.

Embodiment 19: The arrangement as in any prior embodiment, wherein the chamber is sealed from wellbore fluids.

Embodiment 20: A method for connecting a borehole tool to an outside surface of a tubular, including connecting the borehole tool to a first coupler either before or after disposing the coupler on the tubular, disposing the first coupler on the tubular, disposing a wedge on the tubular, disposing a second coupler on the tubular, interconnecting the first coupler and the second coupler, and jamming the wedge against the tubular with the interconnecting.

Embodiment 21: The method as in any prior embodiment, further comprising energizing a seal disposed between the first and second couplers to create a seal against the tubular.

Embodiment 22: A wellbore system, including a borehole in a subsurface formation, a string in the borehole, and an arrangement as in any prior embodiment, disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mechanical stop arrangement for attachment to a separate borehole tubular in any location along the separate borehole tubular to locate and restrain a borehole tool to an outside diameter of the separate borehole tubular, the separate borehole tubular extending past each of two longitudinal ends of the arrangement, comprising:

a first coupler dimensioned and configured to be disposed about the separate borehole tubular and having a clearance fit around the separate borehole tubular, the first coupler having:

a tool connection segment configured to connect with a downhole tool; and an arrangement connection segment;

a second coupler dimensioned and configured to be disposed about the separate borehole tubular and having:

a first connection segment connectable with the arrangement connection section; and a frustoconical inside diameter surface; and a wedge having a radially outside surface angle that is complementary to the frustoconical inside diameter surface.

2. The arrangement as claimed in claim 1, further comprising a seal disposable between the first coupler and second coupler and configured and dimensioned to create a seal against the tubular, when the arrangement is in use.

3. The arrangement as claimed in claim 2, wherein the seal is in contact with the wedge, the second coupler and the first coupler and subject to compression by the arrangement.

4. The arrangement as claimed in claim 1, wherein the wedge also creates a seal.

5. The arrangement as claimed in claim 4, wherein the seal is metal to metal.

6. The arrangement as claimed in claim 4, wherein the wedge includes a sealing material coating.

7. The arrangement as claimed in claim 1, wherein the wedge is a ring.

8. The arrangement as claimed in claim 1, wherein the wedge is a split ring.

9. The arrangement as claimed in claim 1, wherein the wedge is a plurality of wedges arranged about the tubular when in use.

10. The arrangement as claimed in claim 1, wherein the wedge includes a surface texture.

11. The arrangement as claimed in claim 10, wherein the surface texture is teeth.

12. The arrangement as claimed in claim 1, wherein the surface angle is in a range of about 3 degrees to about 15 degrees from a longitudinal axis of the arrangement.

13. The arrangement as claimed in claim 1, wherein the surface angle is in a range of about 3 degrees to about 5 degrees from a longitudinal axis of the arrangement.

14. The arrangement as claimed in claim 1, wherein the borehole tool is an inflow control tool.

15. The arrangement as claimed in claim 1, wherein the borehole tool is a liner hanger.

16. The arrangement as claimed in claim 1, wherein the borehole tool is a packer.

17. The arrangement as claimed in claim 1, wherein the borehole tool is electronics.

18. The arrangement as claimed in claim 1 wherein the borehole tool creates a chamber.

19. The arrangement as claimed in claim 18 wherein the chamber is sealed from wellbore fluids.

20. A wellbore system, comprising:

a borehole in a subsurface formation;

a string in the borehole; and an arrangement as claimed in claim 1, disposed within or as a part of the string.

21. A method for connecting a borehole tool to an outside surface of a separate tubular, comprising:

connecting the borehole tool to a first coupler either before or after disposing the coupler on only an outside surface of the separate tubular;

disposing the first coupler on the separate tubular;

disposing a wedge on the separate tubular;

disposing a second coupler on the separate tubular;

interconnecting the first coupler and the second coupler; and jamming the wedge against the separate tubular with the interconnecting.

22. The method as claimed in claim 21, further comprising energizing a seal disposed between the first and second couplers to create a seal against the tubular.

* * * * *